US007498745B2

(12) United States Patent
Choi et al.

(10) Patent No.: US 7,498,745 B2
(45) Date of Patent: Mar. 3, 2009

(54) PLASMA DISPLAY PANEL PROVIDED WITH ALIGNMENT MARKS HAVING SIMILAR PATTERN THAN ELECTRODES AND METHOD OF MANUFACTURING THE SAME

(75) Inventors: Jung-Hyuck Choi, Suwon-si (KR); Young-Ho Chin, Suwon-si (KR); Chang-Seok Rho, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/297,348

(22) Filed: Dec. 9, 2005

(65) Prior Publication Data

US 2006/0125399 A1 Jun. 15, 2006

(30) Foreign Application Priority Data

Dec. 10, 2004 (KR) ..... 10-2004-0104165

(51) Int. Cl.
*H01J 17/49* (2006.01)
*H01J 9/00* (2006.01)

(52) U.S. Cl. ..... 313/582; 313/584; 313/586; 445/24; 445/25

(58) Field of Classification Search ..... 313/581, 313/567, 162, 306, 568, 582–587; 445/24, 445/25

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.

(Continued)

FOREIGN PATENT DOCUMENTS

EP 1 164 621 12/2001

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Mariceli Santiago
(74) *Attorney, Agent, or Firm*—Robert E. Bushnell, Esq.

(57) ABSTRACT

A manufacturing method of a plasma display panel is to form a transparent electrode pattern on a boundary portion between a display region and a non-display region when the transparent electrode pattern is formed by the laser ablation method. The method includes depositing a transparent electrode material layer on a first substrate, patterning the transparent electrode material layer in a display region to form a transparent electrode pattern in the display region, patterning the transparent electrode material layer in a boundary portion to form a transparent electrode pattern in the boundary portion arranged between the display region and a non-display region, depositing a metal conductive layer on the transparent electrode pattern in the display region, patterning the metal conductive layer to form a bus electrode, forming an address electrode and a barrier rib on a second substrate, and aligning and assembling a first plate that includes the first substrate to a second plate that includes the second substrate so that the address electrode and the barrier rib each intersect each of the bus electrode and the transparent electrode pattern in the display region.

18 Claims, 6 Drawing Sheets

U.S. PATENT DOCUMENTS

| | | | | |
|---|---|---|---|---|
| 5,724,054 | A | 3/1998 | Shinoda | |
| 5,786,794 | A | 7/1998 | Kishi et al. | |
| 5,952,782 | A | 9/1999 | Nanto | |
| 6,200,182 | B1 | 3/2001 | Nanto et al. | |
| RE37,444 | E | 11/2001 | Kanazawa | |
| 6,433,489 | B1 | 8/2002 | Tanaka et al. | |
| 6,630,916 | B1 | 10/2003 | Shinoda | |
| 6,646,375 | B1 | 11/2003 | Nagano | |
| 6,707,436 | B2 | 3/2004 | Setoguchi et al. | |
| 2003/0134506 | A1* | 7/2003 | Kim et al. | 438/637 |
| 2004/0000872 | A1 | 1/2004 | Ikeya et al. | |
| 2004/0195576 | A1* | 10/2004 | Watanabe et al. | 257/79 |
| 2005/0077823 | A1* | 4/2005 | Song et al. | 313/582 |
| 2005/0093448 | A1* | 5/2005 | Moon et al. | 313/582 |
| 2005/0206316 | A1* | 9/2005 | Lee et al. | 313/582 |
| 2005/0221713 | A1 | 10/2005 | Wan et al. | |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2000-299066 | 10/2000 |
| JP | 2001-043804 | 2/2001 |
| JP | 2001-086896 | 3/2001 |
| JP | 2001-325888 | 11/2001 |
| KR | 2001-0043102 | 5/2001 |
| KR | 10-2005-0101775 | 10/2005 |
| KR | 2005101775 A * | 10/2005 |

* cited by examiner

PLASMA DISPLAY PANEL PROVIDED WITH ALIGNMENT MARKS HAVING SIMILAR PATTERN THAN ELECTRODES AND METHOD OF MANUFACTURING THE SAME

CLAIM OF PRIORITY

This application makes reference to, incorporates the same herein, and claims all benefits accruing under 35 U.S.C. §119 from an application earlier filed in the Korean Intellectual Property Office on 10 Dec. 2004 and there duly assigned Ser. No. 10-2004-0104165.

BACKGROUND OF THE INVENTION

1. Field of the Invention

The present invention relates to a plasma display panel and a method of manufacturing the same, and more particularly to a plasma display panel where a transparent electrode pattern of a display region is also formed on a boundary portion between the display region and a non-display region, and a method of manufacturing the same.

2. Description of the Related Art

A plasma display panel (PDP) is a display device that displays images using a gas discharge phenomenon. The PDP has superior display characteristics, such as display capacity, brightness, contrast, after-image, and viewing angle.

The PDP generates a gas discharge between electrodes within a discharge cell when a driving voltage is applied to the electrodes of the discharge cell. This causes vacuum ultraviolet rays to form and excite phosphors so that visible light can be emitted to realize display images.

The PDP includes a display electrode on the inner surface of a first substrate, an address electrode on an inner surface of a second substrate, and a barrier rib located between the two substrates to form the discharge cell. In the PDP, a discharge gas is filled within the discharge cell.

The display electrode is actually a pair of electrodes. The two electrodes in the pair are called a sustain electrode and a scanning electrode. The sustain electrode and the scanning electrode are located in each discharge cell and are used to generate a sustain discharge. The display electrode and the address electrode are oriented to intersect each other and together serve to select the discharge cell.

Each of the sustain electrode and the scanning electrode is made up of a transparent electrode that is used to generate a surface discharge within the discharge cell and a bus electrode that is used to apply a voltage to the transparent electrode. The transparent electrode is made out of ITO (Indium Tin Oxide) and is located on the first substrate to increase the aperture ratio (i.e., the transmittance of visible light generated within the discharge cell). The bus electrode is made out of a highly conductive metal.

To form the transparent electrode on the front substrate, a photolithography technique or a laser ablation technique can be used. The photolithography technique includes the steps of applying an ITO material to the first substrate by sputtering, patterning the ITO material to form the transparent electrode pattern, applying the metal conductive material onto the transparent electrode pattern, and patterning the metal conductive material to form the bus electrode. Since the photolithography technique requires photoresist coating, photoresist patterning and then an etching process, the photolighography technique is very time consuming, is complicated and is expensive. In contrast, the laser ablation technique is advantageous in that it may reduce the number of process steps and reduce the processing time in forming the transparent electrode pattern. Further, laser ablation can enhance the straightness of the end portion of the transparent electrode pattern formed when patterning the ITO layer.

The transparent electrode, when produced by the laser ablation technique, is formed by coating the ITO layer on the inner surface of the first substrate, and then patterning the ITO layer in the display region of the PDP. Since gas discharge does not occur in the non-display region of the PDP, the bus electrode and the transparent electrode are not formed in the non-display region, and thus there is no need to pattern the transparent electrode material deposited in the non-display region. Therefore, the ITO material applied to the non-display region is removed by laser ablation, resulting in an increase the process time. What is needed is an improved design for a PDP and an improved technique of making the PDP that is less complicated and further reduces processing time beyond that of the above laser ablation technique.

SUMMARY OF THE INVENTION

It is therefore an object of the present invention to provide an improved design for a PDP.

It is also an object of the present invention to provide an improved technique of making a PDP that is less complicated, requires less processing time, and less inexpensive.

These and other objects can be achieved by a plasma display panel and its manufacturing method in which a transparent electrode pattern is formed on a boundary portion between a display region and a non-display region when a transparent electrode pattern is formed by laser ablation method. An alignment mark for a subsequent bus electrode pattern, a transparent electrode, and a disconnect between the transparent electrode and non-display portions of the PDP are all formed in sequence or simultaneously by laser ablation in the same ITO layer using the same pattern.

According to one aspect of the present invention, the method of manufacturing a plasma display panel includes depositing a transparent electrode material layer on a first substrate, patterning the transparent electrode material layer in a display region to form a transparent electrode pattern, patterning the transparent electrode material layer in a boundary portion between the display region and a non-display region to form a boundary pattern, depositing a metal conductive layer on the transparent electrode pattern in the display region, patterning the metal conductive layer to form a bus electrode, forming an address electrode and a barrier rib on a second substrate and aligning and assembling a first plate that includes the first substrate to a second plate that includes the second substrate so that each of the address electrode and the barrier rib intersect each of the bus electrode and the transparent electrode pattern in the display region.

The boundary pattern in the boundary portion can have a same pattern as the transparent electrode pattern in the display region.

The transparent electrode pattern in the boundary portion can include a plurality of disconnection lines.

The method can further include forming an alignment mark by laser ablation of the transparent electrode material layer in the non-display region at one side of the display region.

In the forming of the alignment mark, a single alignment mark, having a same pattern as the transparent electrode pattern formed in the display region, can be formed in the transparent electrode material layer in the non-display regions at both of an upper end and at a lower end of the first substrate.

In the forming of the alignment mark, a pair of alignment marks, each of said pair having a same pattern as the transparent electrode pattern formed in the display region, can be formed in the transparent electrode material layer in the non-display regions at both of an upper end and at a lower end of the first substrate.

According to another aspect of the present invention, a plasma display panel includes a transparent electrode comprising a transparent conductive material, the transparent electrode having a first pattern and being arranged in a display region of a first substrate, a boundary pattern comprising the transparent conductive material, the boundary pattern being arranged in a boundary portion between the display region and a non-display region of the first substrate, a bus electrode arranged on the transparent electrode, an address electrode arranged on a second substrate, the address electrode extending in a direction that intersects the transparent electrode and the bus electrode, and a barrier rib arranged between the first substrate and the second substrate, the barrier rib defining a discharge cell between the first substrate and the second substrate.

The boundary pattern can have an identical pattern to the first pattern.

The boundary pattern can include a plurality of disconnection lines.

The plasma display panel can further include an alignment mark that includes the transparent conductive material and arranged in the non-display region of the first substrate.

The alignment mark can be arranged in a pattern identical to the first pattern, the alignment mark being arranged at both an upper end and lower end of the first substrate, each alignment mark being arranged in the non-display region.

The alignment mark can be a pair of marks, each mark having a pattern identical to the first pattern, the alignment mark being arranged at both an upper end and lower end of the first substrate, each alignment mark being arranged in the non-display region.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
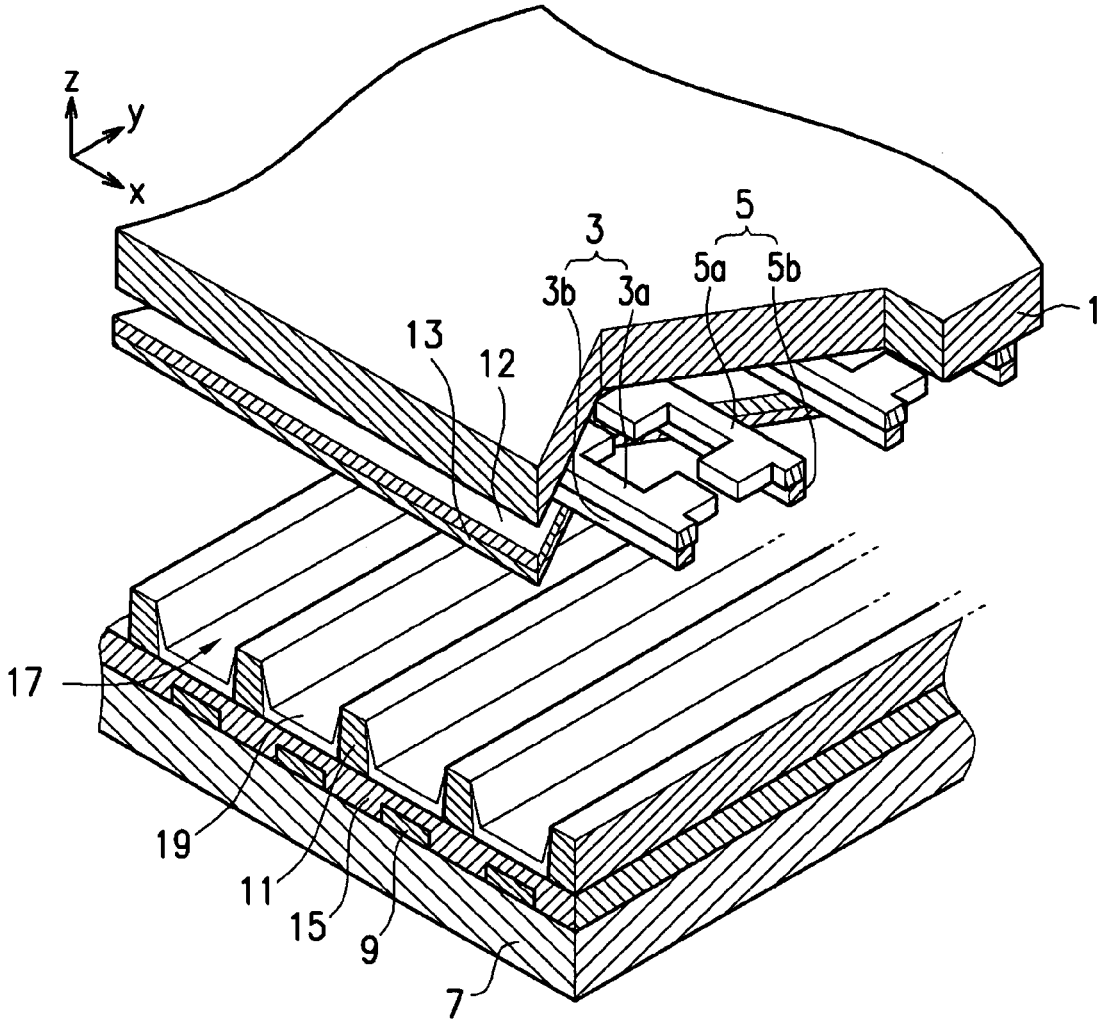
FIG. 1 is a schematic partial exploded perspective view of a plasma display panel according to one embodiment of the present invention.

Turning now to the figures, FIG. 1 is a schematic partial exploded perspective view of a plasma display panel (PDP) according to one embodiment of the present invention. With reference to FIG. 1, the panel includes a first substrate 1 (hereinafter "the front substrate") having a sustain electrode 3 and a scanning electrode 5 on the inner surface thereof to function as a display electrode, a second substrate 7 (hereinafter "the rear substrate") having an address electrode 9 on the inner surface thereof, and a barrier rib 11 located between these two substrates 1 and 7. The sustain electrode 3 and the scanning electrode 5 are formed as a pair, and a sustain discharge occurs between the sustain electrode 3 and the scanning electrode 5 when the PDP functions. The sustain electrode 3 and the scanning electrode 5 and the address electrode 9 are formed in a stripe shape on the inner surfaces of the front substrate 1 and the rear substrate 7, respectively. The address electrode 9 crosses under the sustain electrode 3 and the scanning electrode 5 when the rear substrate 7 is assembled to the front substrate 1. A dielectric layer 12 and a MgO protective layer 13 covers the sustain electrode 3 and the scanning electrode 5 and are sequentially stacked on the inner surface of the front substrate 1. In addition, on the rear substrate 7, the barrier rib 11 is formed over the surface of a dielectric layer 15 that covers the address electrode 9. The barrier rib 11 defines and forms a discharge cell 17. An inert gas, such as Ne—Xe compound gas, is filled within the discharge cell 17. Furthermore, a phosphor 19 is coated on the inner side surface of the barrier rib 11 and on the surface of the dielectric layer 15 within the discharge cell 17. The sustain electrode 3 and the scanning electrode 5 include transparent electrodes 3*a* and 5*a* that produce a surface discharge in the discharge 5 cell 17 and bus electrodes 3*b* and 5*b* that apply a voltage to the transparent electrodes 3*a* and 5*a*. Although in the PDP of FIG. 1, the sustain electrode 3 and the scanning electrode 5 include protruded transparent electrodes 3*a* and 5*a* and the address electrode 9 has a stripe shape, the present invention is in no way limited to such shapes. In addition, the barrier rib 11 forming the discharge cell 17 is not limited to a stripe shape, but instead can have a lattice shape and still be within the scope of the present invention.

Figure 2:
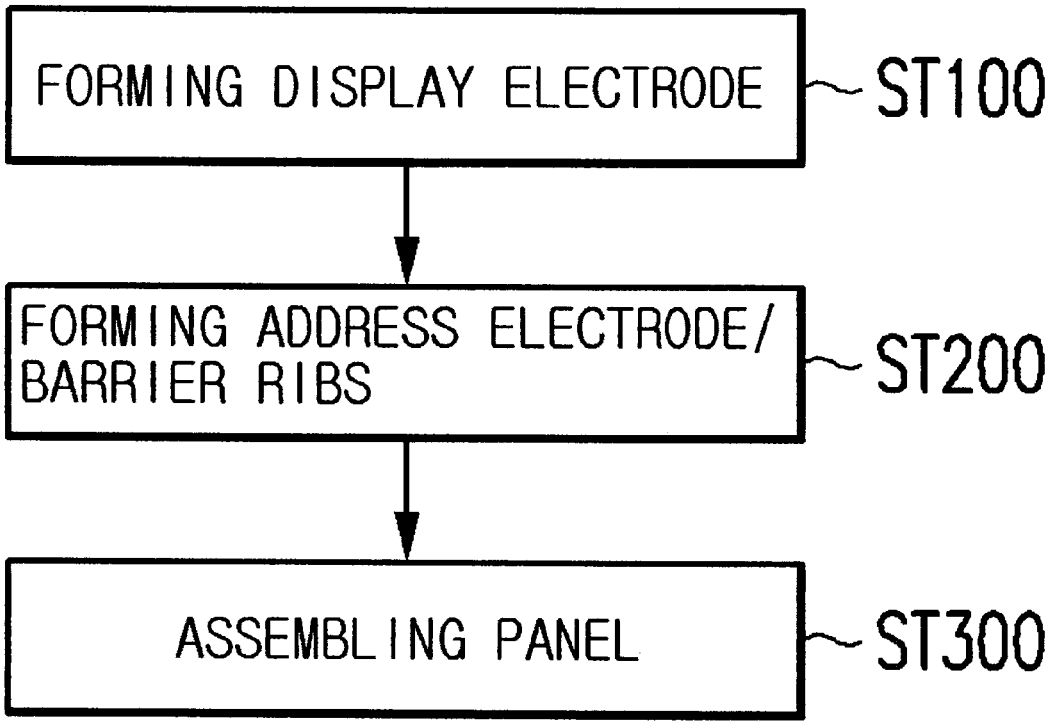
FIG. 2 is a flow chart of a method of manufacturing a plasma display panel according to one embodiment of the present invention.

Turning now to FIGS. 2 and 3A through 3E, FIG. 2 is a flow chart of a method of manufacturing the PDP of FIG. 1 according to one embodiment of the present invention and FIGS. 3A through 3E are cross sectional views of the processing on the front substrate 1 of the PDP of FIG. 1 to sequentially illustrate the formation of the transparent electrode pattern on the front substrate 1 by laser ablation technique according to the present invention. With reference to FIG. 2, the manufacturing method of the PDP includes the steps of forming the display electrode (i.e. the sustain electrode 3 and the scanning electrode 5) on the front substrate 1 (ST100), forming the address electrode 9 and the barrier rib 11 on the rear substrate 7 (ST200), and assembling the front plate including the front substrate 1 to the rear plate including the rear substrate 7 to complete the PDP (ST300).

The step of forming the display electrode (ST100) includes the steps of forming the sustain electrode 3 and the scanning electrode 5 in parallel on the inner surface of glass front substrate 1, and stacking the dielectric layer 12 and the MgO protection layer 13 on the sustain electrode 3 and the scanning electrode 5 to complete the front plate.

Figure 3A:
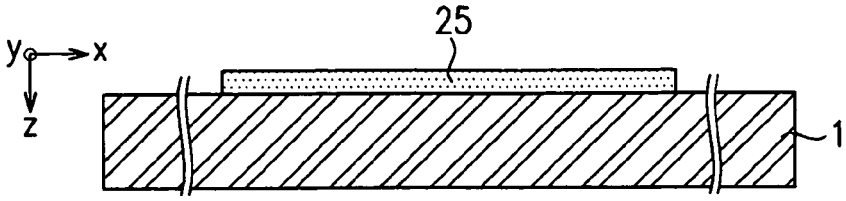
FIGS. 3A to 3E are cross sectional views of a first substrate of the plasma display panel to sequentially illustrate forming a transparent electrode pattern on the first substrate by laser ablation according to one embodiment of the present invention.
Figure 3B:
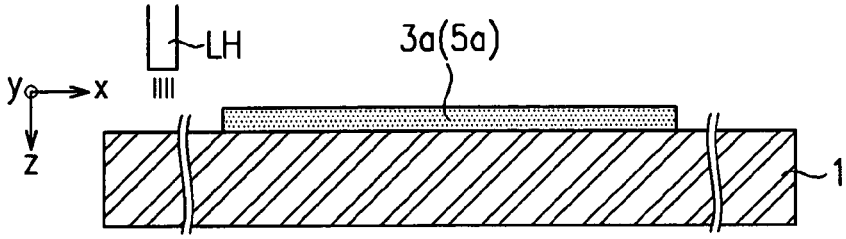
Figure 3C:
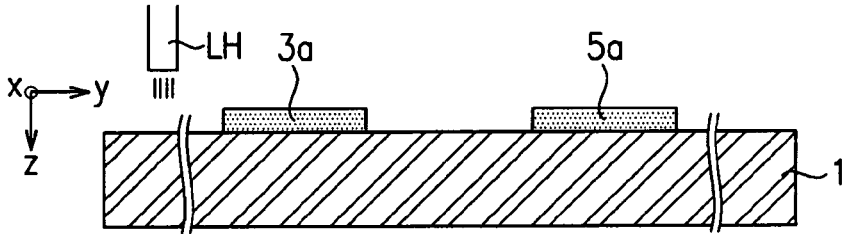
Figure 3D:
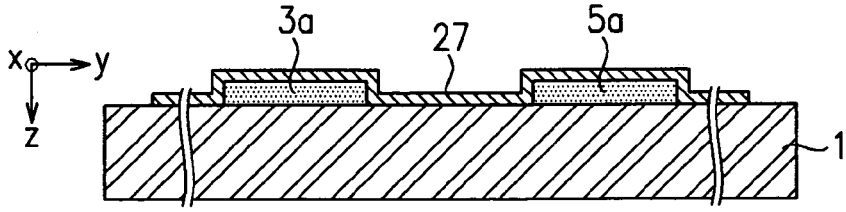
Figure 3E:
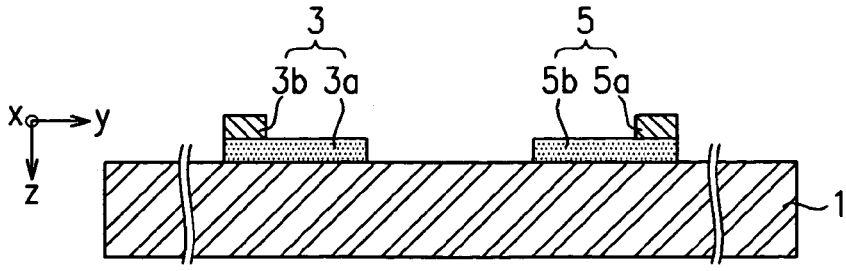

The step of forming the display electrode (ST100), i.e. the step of forming the sustain electrode 3 and the scanning electrode 5 includes the steps of forming the transparent electrodes 3*a* and 5*a* (see FIGS. 3A to 3C) and the step of forming the bus electrodes 3*b* and 5*b* on the transparent electrodes 3*a* and 5*a* (see FIGS. 3D to 3E). The step of forming the transparent electrodes 3*a* and 5*a* includes the steps of applying a transparent electrode material layer (ITO layer) 25 on the inner surface of the front substrate 1 (see FIG. 3A), and patterning the ITO layer 25 by laser ablation (see FIGS. 3B to 3B) to form the transparent electrodes 3*a* and 5*a*. The step of forming the bus electrodes 3*b* and 5*b* includes the steps of coating a metal conductive layer on the transparent electrodes 3*a* and 5*a* (see FIG. 3D), drying the metal conductive layer followed by patterning by light exposure and development (see FIG. 3E) to form the bus electrodes 3*b* and 5*b*. The transparent electrode material layer is preferably ITO (Indium Tin Oxide).

Figure 4:
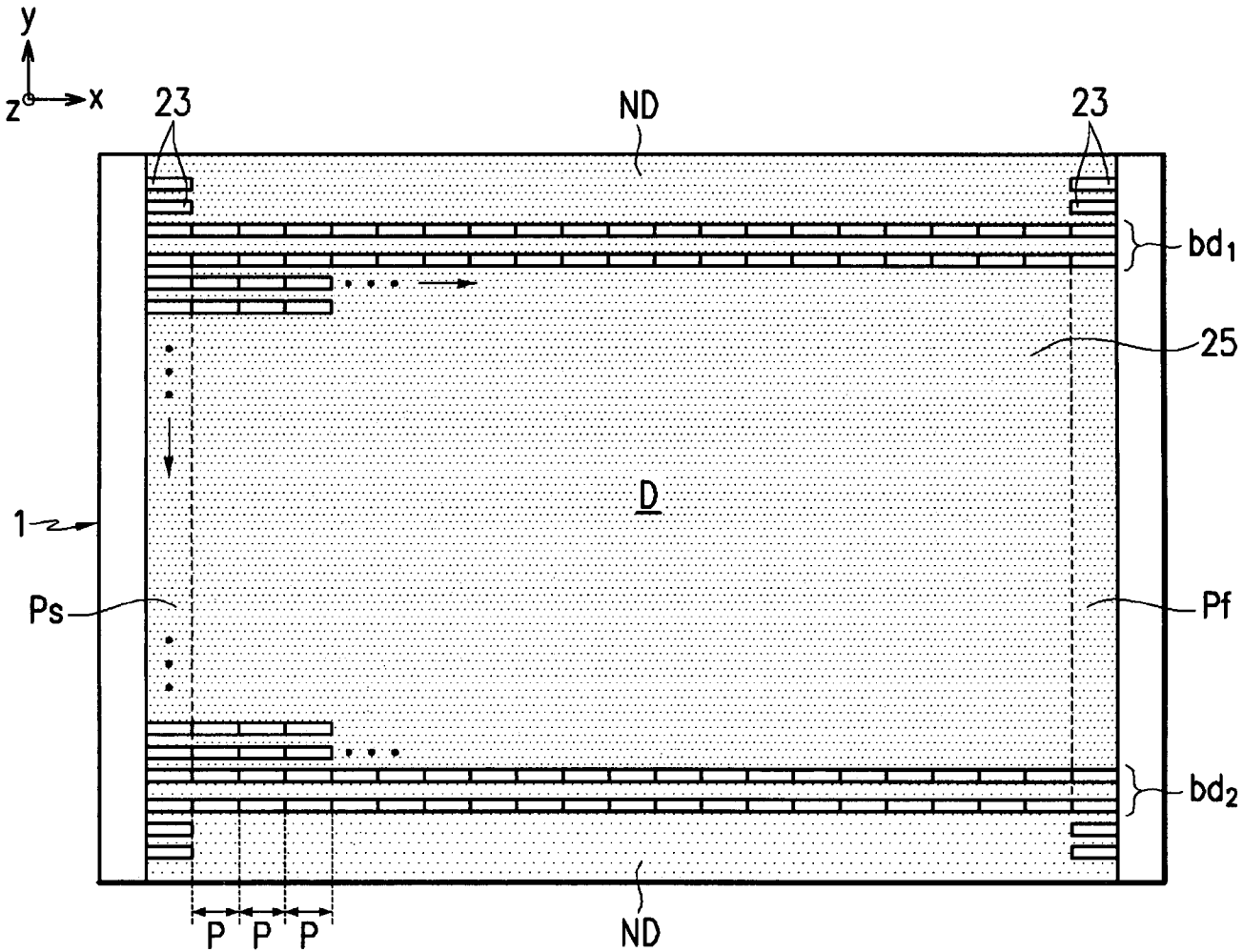
FIG. 4 is a schematic plan view of the first substrate of the plasma display panel to illustrate forming the transparent electrode pattern on the first substrate by laser ablation according to one embodiment of a manufacturing method of the plasma display panel of the present invention.
Figure 5:
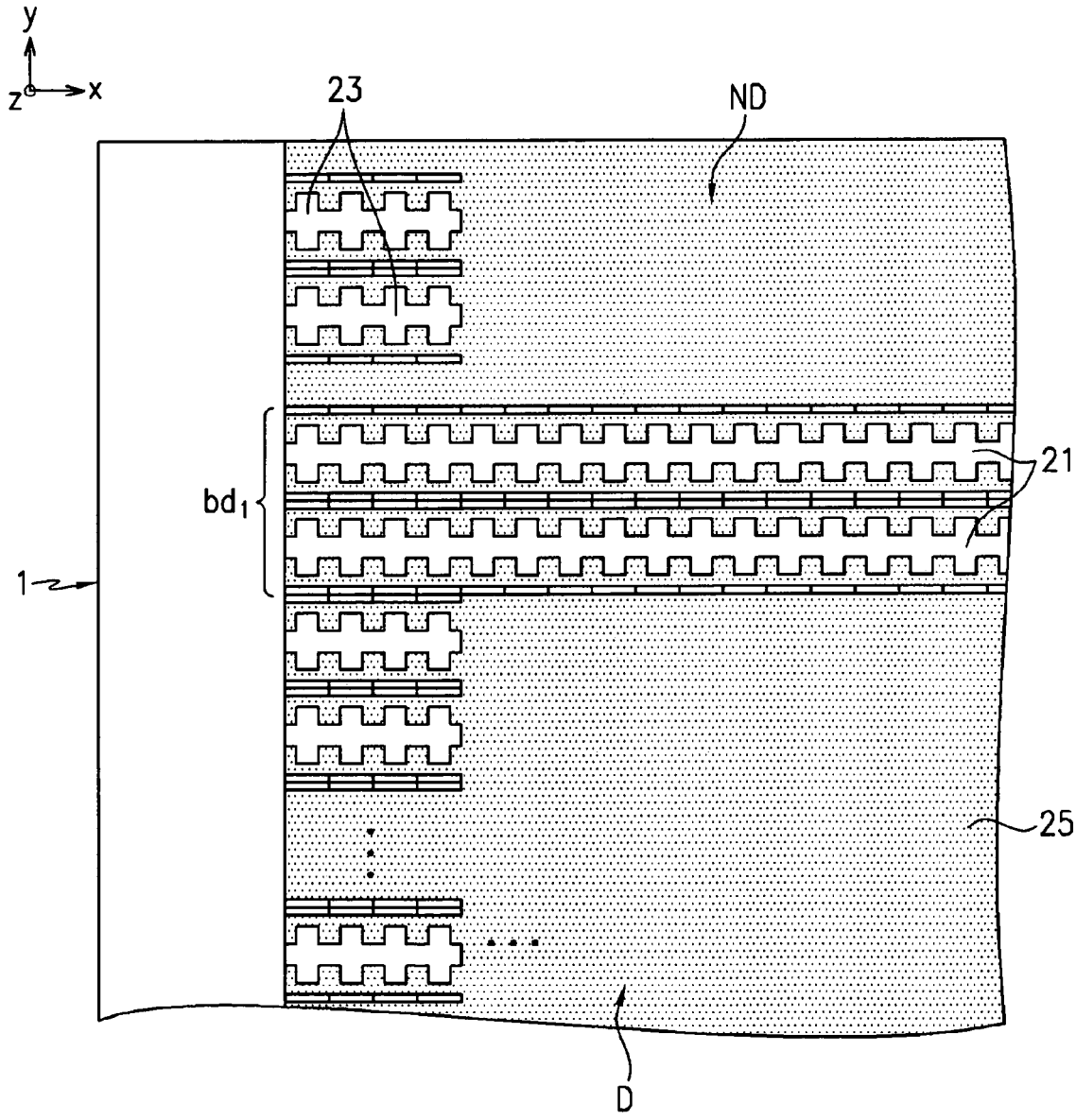
FIG. 5 is a partial detailed view of FIG. 4.
Figure 6:
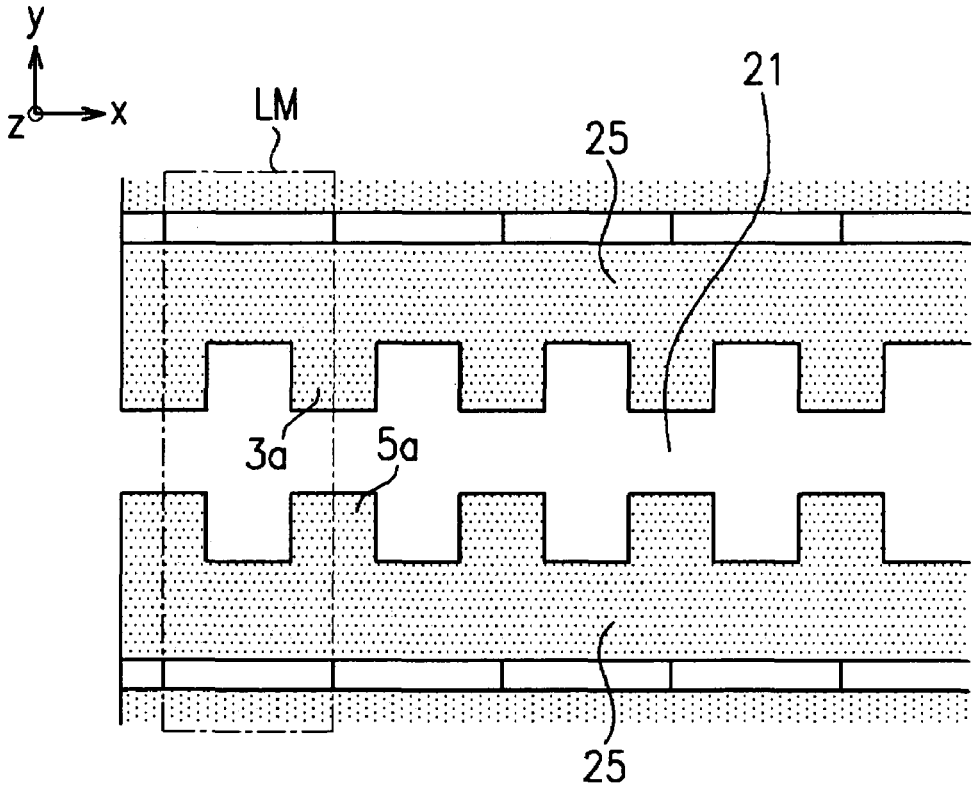
FIG. 6 is a detailed view of a transparent electrode pattern formed in a boundary portion between a display region and a non-display region.

Turning now to FIGS. 4 through 6, FIG. 4 is a schematic plan view of the front substrate of the plasma display panel according to one embodiment of the present invention to illustrate the formation the transparent electrode pattern (P) on the first substrate by laser ablation, FIG. 5 is a partial detailed view of FIG. 4, and FIG. 6 is a detailed view of a transparent electrode pattern (boundary pattern) formed in a boundary portion between a display region (D) and a non-display region (ND). As illustrated in FIG. 4, the patterning of the ITO layer 25 includes the steps of forming a transparent electrode pattern (P) in display region (D) of the PDP and forming the same transparent electrode pattern (P) in boundary portions ($bd_1$, $bd_2$) located between the display region (D) and a non-display region (ND) of the PDP.

The step of forming the transparent electrode pattern (P) in the boundary portions ($bd_1$, $bd_2$) results in the design as shown in FIG. 4. This step of forming the transparent electrode pattern (P) in the boundary portions ($bd_1$, $bd_2$) forms the same pattern (P) in the boundary portions as the transparent electrode pattern (P) formed on the display region (D). Since this pattern of the ITO layer formed in the boundary portions ($bd_1$, $bd_2$) is the same as the pattern formed in the display region (D), a separate mask is not needed to pattern the ITO layer in the boundary portions ($bd_1$, $bd_2$).

The transparent electrode pattern (P) formed in the boundary portions (bd1, bd2) separates the display region (D) from the non-display region (ND) of the PDP and serves to disconnect the ITO layer of both sides of the boundary portions (bd1, bd2). A disconnection line 21 maybe formed by etching the ITO layer 25 while moving the laser head, having a predetermined laser mask (LM) attached, along the x-axis direction, the laser mask (LM) being patterned to have a center portion cut out (refer to FIG. 6). The disconnection line 21 formed in the boundary portions (bd1, bd2) may electrically insulate the ITO electrodes in the display region (D) from the ITO in the non-display region (ND). If the disconnection line 21 is formed more than twice (formed twice in FIG. 4 and FIG. 5 respectively), the disconnection effect can be further enhanced. The disconnection line 21 formed in the boundary portions (bd1, bd2) disconnects the ITO layer coated on the non-display region (ND) from the transparent electrodes 3*a* and 5*a* of the display region (D). As a result, it is now no longer necessary to remove the ITO layer from the non-display region (ND) so that the process time for forming the transparent electrodes can be further decreased.

Following the patterning of ITO layer 25, the bus electrodes 3*b* and 5*b* are formed in the display region (D) only. The bus electrodes 3*b* and 5*b* in the display region (D) must be aligned with the underlying patterned transparent electrodes 3*a* and 5*a* so that bus electrodes 3*b* and 5*b* can apply a voltage to the corresponding transparent electrodes 3*a* and 5*a* to generate surface discharge in the discharge cell 17 within the PDP upon application of a sustain voltage.

The bus electrodes 3*b* and 5*b* are patterned by aligning a photoresist mask (not shown) having the bus electrode pattern to the transparent electrode pattern formed underneath a blanket layer of highly conductive metal, carrying out light exposure, development and etching to pattern the highly conductive metal layer. The alignment of the photoresist mask is based on the alignment marks 23 formed on the front substrate 1. Accordingly, it is preferable that the alignment marks 23 for forming the bus electrodes 3*b* and 5*b* are made to relate to the transparent electrode pattern (P) to precisely align the bus electrode pattern and the transparent electrode pattern (P).

To facilitate the alignment process, the step of forming the transparent electrode can include the step of forming alignment marks 23. That is, before processing the bus electrodes 3*b* and 5*b*, when the transparent electrodes 3*a* and 5*a* are patterned in the display region (D) of the front substrate 1 by the laser ablation, the alignment marks 23 can be formed on one side of the display region (D) of the PDP by laser ablation of the ITO layer 25. After this, the bus electrodes 3*b* and 5*b* can be formed as being aligned to these alignment marks 23.

The alignment marks 23 can have the same pattern as the pattern (P) used in the ITO layer in the display area (D) and in the boundary portions. The alignment marks 23 are also located in the ITO layer but are found in the non-display region (ND) at the upper end and the lower end of the front substrate 1. Furthermore, the step of forming the alignment marks 23 can entail forming a pair of the alignment marks 23 having the transparent electrode pattern (P) at both sides of the display region (D) in the non-display region (ND) at both the upper end of first substrate 1 and at the lower end of the first substrate 1 as in FIG. 4.

In the meantime, the manufacturing method of the PDP according to the present invention includes the step of forming the display electrode as shown in FIGS. 3A through 3E. The step of forming the display electrode includes the steps of applying the ITO layer 25 to the front substrate 1, forming the transparent electrode pattern (P) by laser ablation of the ITO layer 25, and applying the bus electrode material and aligning and forming the bus electrode pattern. As the ITO layer 25 can be applied by various methods, the details thereof will be omitted, and the following description will focus on the laser ablation patterning of the ITO layer 25.

The ITO layer 25 is patterned into the protruding transparent electrodes 3*a* and 5*a* on the front substrate 1 (FIGS. 3B to 3C) by the laser ablation method having transparent electrode pattern (P) (FIGS. 4 to 6). Specifically, the laser ablation method progresses on the upper side of the front substrate 1 by one scan width along the positive x direction of FIG. 4, moves by one line along the negative y direction of FIG. 4, progresses by one scan width along the negative x direction of FIG. 4, moves again by one line along the negative y direction of FIG. 4, and then repeats the process of progressing by one scan width along the positive x direction of FIG. 4 to form the transparent electrode pattern (P) one row at a time.

Alternatively, the laser ablation method can instead form the transparent electrode pattern (P) corresponding to one scan width along the y direction, and moves by one scan width along the x direction and then repeats the above process to achieve formation of transparent electrode pattern (P) in the ITO layer 25 of the display region (D) of the front substrate 1. Accordingly, a plurality of the scan columns (P, . . . , P) are achieved.

In FIG. 4, when the transparent electrode pattern (P) scans along the x direction, scan columns (P, . . . , P) are defined, and the scanning is completed when these scan columns are completed. FIG. 4 shows only four scan rows along the X-axis direction and omits the others. The scan width is made up of the continuation of a laser mask (LM) as shown in FIG. 6.

When the ITO layer 25 is patterned into the transparent electrode pattern (P), the alignment marks 23 are engraved or etched in the non-display region (ND) outside of where the display image is formed. Because the pattern of the alignment marks is the same as the pattern (P) of the transparent electrodes, and because both the alignment marks and the transparent electrodes are both formed in the same ITO layer, the step of forming the alignment marks 23 can occur when the ITO layer 25 is patterned to form the transparent electrodes 3*a* and 5*a*. As a result, each of the transparent electrodes, the alignment marks and the boundary disconnections can all be formed in the same ITO layer using the same pattern (P) during the same laser ablation step. This results in time savings as well as reduces costs and reduces process complexity.

The forming of the alignment marks 23 can be achieved in various ways. For example, if the transparent electrode pattern (P) is repeatedly scan patterned on the front substrate 1 column by column (P, . . . , P), it is preferable that the alignment marks are formed during the scanning of the first scan column (Ps) and during the scanning of the last scan column (Pf), respectively. If the transparent electrode pattern (P) is formed by laser ablation, the precision and the straightness of the transparent electrode pattern (P) are influenced by the precision and the straightness of the laser head (LH). Similarly, the precision and straightness of the alignment marks 23 formed by the laser ablation are also influenced by the precision and the straightness of the laser head (LH). Accordingly, if the alignment marks 23 are formed in the first scan column (Ps) and the last scan column (Pf), respectively, the alignment marks 23 can be effectively used to align the bus electrode pattern.

More specifically, the alignment marks 23 can be formed at the starting point and the ending point of one scan column. As illustrated in FIG. 4, the alignment marks 23 are formed at the starting points and the ending points of the first and last scan columns Ps and Pf, respectively. The alignment marks 23 are formed in the ITO layer 25 and in the non-display region (ND) at the upper end and at the lower end of the front substrate 1. Furthermore, the alignment marks can have the same pattern (P) as the processed portion of the display region (D). In addition, the alignment marks 23 can be formed at both sides of the upper end in the non-display region (ND) and at both sides of the lower end in the non-display region (ND) of the front substrate 1, and the alignment marks 23 can each be a pair of patterns (P), each pattern (P) being identical to the processed portion of the transparent electrode pattern (P). When the alignment marks 23 are formed in pairs as in FIGS. 4 and 5, the bus electrode mask can be more precisely aligned than when the alignment marks 23 are formed in single.

In addition, it is preferable that the alignment marks 23 are formed to have the same width as the width of one scan of the transparent electrode pattern (P) corresponding to one column (P) so that the laser head (LH) can move along the Y-axis direction to form the alignment marks like the laser ablation of the transparent electrode pattern (P).

In the meantime, the transparent electrode pattern (P) formed in the boundary portions ($bd_1$, $bd_2$) can be formed in the boundary portion between the display region (D) and the non-display region (ND) of the PDP by the same process as that of the transparent electrodes 3*a* and 5*a* of the display region (D). However, if the transparent electrode pattern (P) of the boundary portions ($bd_1$, $bd_2$) forms a single disconnection line 21, it is preferable that the laser head forming this disconnect pattern moves along the X-axis direction of FIG. 4.

The metal conductive layer 27 is formed on the transparent electrodes 3*a* and 5*b* and on the alignment marks 23 (see FIG. 3D). This metal conductive layer 27 can be formed by coating a photosensitive electrode paste to a predetermined thickness or by attaching a photosensitive electrode tape. The metal conductive layer 27 is then dried. The metal conductive layer 27 is then exposed to light and etched to form the bus electrodes 3*b* and 5*b*. For this exposure, a mask (not shown) with the bus electrode pattern is aligned to the alignment marks 23. After alignment of the mask, the metal conductive layer 27 is exposed and etched to form the bus electrode 3*b* and 5*b* pattern (see FIG. 3E).

As described above, after the sustain electrode 3 and the scanning electrode 5, having the transparent electrodes 3*a* and 5*a* and the bus electrodes 3*b* and 5*b* are formed on the front substrate 1, respectively, the dielectric layer 12 and the MgO protective layer 13 cover these electrodes 3 and 5 to complete the front plate. In addition, after the address electrode 9 is formed on the rear substrate 7, the dielectric layer 15 is formed to cover the address electrode 9 and the barrier rib 11 is formed on the dielectric layer 15. A phosphor layer 17 is then deposited on the sidewalls of the barrier rib 11 and on exposed portions of the dielectric layer 15 to complete the rear plate. After processing of the front and rear plates are complete, the front plate and the rear plate are assembled together and the discharge space inside thereof is exhausted to form a high vacuum state. Then, a discharge gas is filled to a predetermined pressure to complete the PDP.

As described above, the present invention produces a disconnection line 21 between the display region (D) and the non-display region (ND) and patterns the transparent electrode of the display electrode on the front substrate by the laser ablation method. The same pattern (P) is used to pattern the ITO layer in both the display region (D) and the boundary portion ($bd_1$, $bd_2$) between the display region (D) and the non-display region (ND) as well as in the non-display region (ND) to form alignment marks. By doing so, the ITO layer need not be removed from the non-display region (ND), and the processes such as stage movement, separate mask change, etc. for forming the disconnection line are unnecessary. Accordingly, process time is saved during the formation of the transparent electrode pattern on the front substrate.

Although a few embodiments of the present invention have been shown and described, it would be appreciated by those skilled in the art that changes can be made in this embodiment without departing from the principles and spirit of the invention, the scope of which is defined in the claims and their equivalents.

What is claimed is:

1. A method of manufacturing a plasma display panel, comprising:

depositing a transparent electrode material layer on a first substrate;

patterning the transparent electrode material layer in a display region to form a transparent electrode pattern;

patterning the transparent electrode material layer in a boundary portion between the display region and a non-display region to form a boundary pattern;

depositing a metal conductive layer on the transparent electrode pattern in the display region only;

patterning the metal conductive layer to form a bus electrode;

forming an address electrode and a barrier rib on a second substrate; and aligning and assembling a first plate that includes the first substrate to a second plate that includes the second substrate so that each of the address electrode and the barrier rib intersect each of the bus electrode and the transparent electrode pattern in the display region, wherein the boundary pattern in the boundary portion is a same pattern as the transparent electrode pattern in the display region.

2. The method of claim 1, wherein the boundary pattern comprises a plurality of disconnection lines.

3. The method of claim 1, further comprising forming an alignment mark by laser ablation of the transparent electrode material layer in the non-display region at one side of the display region.

4. The method of claim 3, wherein in the forming of the alignment mark, a single alignment mark, having a same pattern as the transparent electrode pattern formed in the display region, is formed in the transparent electrode material layer in the non-display regions at both of an upper end and at a lower end of the first substrate.

5. The method of claim 3, wherein in the forming of the alignment mark, a pair of alignment marks, each of said pair having a same pattern as the transparent electrode pattern formed in the display region, are formed in the transparent electrode material layer in the non-display regions at both of an upper end and at a lower end of the first substrate.

6. The method of claim 3, wherein the forming of the alignment mark, the patterning of the transparent electrode material layer in the boundary portion and the patterning of the transparent electrode material layer in the display region each being accomplished simultaneously.

7. The method of claim 1, wherein the patterning of the transparent electrode material layer in the boundary portion and the patterning of the transparent electrode material layer in the display region each being produced by laser ablation.

8. The method of claim 3, wherein the patterning of the transparent electrode material layer in the boundary portion and the patterning of the transparent electrode material layer in the display region each being produced by laser ablation.

9. The method of claim 3, wherein the patterning of the metal conductive layer being achieved by aligning a pattern for the bus electrode with the alignment mark produced in the transparent electrode material.

10. The method of claim 1, the method being absent of removal of any additional transparent electrode material from the non-display region.

11. The method of claim 3, the method being absent of removal of any additional transparent electrode material from the non-display region.

12. The method of claim 1, the transparent electrode material layer comprises indium tin oxide.

13. A plasma display panel, comprising:

a transparent electrode comprising a transparent conductive material, the transparent electrode having a first pattern and being arranged in a display region of a first substrate, wherein the transparent conductive material being also present in a non-display region of the substrate;

a boundary pattern comprising the transparent conductive material, the boundary pattern being arranged in a boundary portion between the display region and the non-display region of the first substrate;

a bus electrode arranged on the transparent electrode in the display region only;

an address electrode arranged on a second substrate, the address electrode extending in a direction that intersects the transparent electrode and the bus electrode; and a barrier rib arranged between the first substrate and the second substrate, the barrier rib defining a discharge cell between the first substrate and the second substrate, wherein the boundary pattern has an identical pattern to the first pattern.

14. The plasma display panel of claim 13, wherein the boundary pattern comprises a plurality of disconnection lines.

15. The plasma display panel of claim 13, further comprising an alignment mark comprising the transparent conductive material and arranged in the non-display region and on the first substrate.

16. The plasma display panel of claim 15, wherein the alignment mark is arranged in a pattern identical to the first pattern, the alignment mark being arranged at both an upper end and at lower end of the first substrate.

17. The plasma display panel of claim 15, wherein the alignment mark is a pair of marks, each mark of said pair of marks having a pattern identical to the first pattern, the alignment mark being arranged at both an upper end and at lower end of the first substrate.

18. A method of manufacturing a plasma display panel, comprising:

depositing a transparent electrode material layer on a first substrate;

patterning the transparent electrode material layer in each of a display region, a non-display region and a boundary portion between the display region and the non-display region via laser ablation to produce a transparent electrode in the display region and an alignment mark in the non-display region, said patterning causing remaining the transparent electrode material layer in the non-display region being electrically insulated from the transparent electrode in the display region, said boundary portion including patterned transparent electrode material only;

depositing a metal conductive layer on the transparent electrode pattern in the display region only;

patterning the metal conductive layer to form a bus electrode by aligning a pattern for the bus electrode with the alignment mark;

forming an address electrode and a barrier rib on a second substrate; and aligning and assembling a first plate that includes the first substrate to a second plate that includes the second substrate so that each of the address electrode and the barrier rib intersect each of the bus electrode and the transparent electrode.

* * * * *